US008593383B2

(12) United States Patent
Chen

(10) Patent No.: US 8,593,383 B2
(45) Date of Patent: Nov. 26, 2013

(54) LIQUID CRYSTAL DISPLAY WITH PRECHARGE CIRCUIT

(75) Inventor: Chung-Chun Chen, Hsin-Chu (TW)

(73) Assignee: AU Optronics Corporation, Hsin-Chu (TW)

( * ) Notice: Subject to any disclaimer, the term of this patent is extended or adjusted under 35 U.S.C. 154(b) by 662 days.

(21) Appl. No.: 12/042,513

(22) Filed: Mar. 5, 2008

(65) Prior Publication Data

US 2009/0051634 A1 Feb. 26, 2009

(30) Foreign Application Priority Data

Aug. 21, 2007 (TW) ..... 96130935 A

(51) Int. Cl.
*G09G 3/36* (2006.01)

(52) U.S. Cl.
USPC ..... 345/87

(58) Field of Classification Search
USPC ..... 345/87, 83, 94, 211, 212
See application file for complete search history.

(56) References Cited

U.S. PATENT DOCUMENTS

| | | | | |
|---|---|---|---|---|
| 5,426,447 | A | 6/1995 | Lee | |
| 5,764,207 | A | 6/1998 | Maekawa et al. | |
| 5,892,493 | A | 4/1999 | Enami et al. | |
| 5,973,658 | A | 10/1999 | Kim et al. | |
| 6,313,819 | B1 * | 11/2001 | Maekawa et al. | 345/92 |
| 6,356,253 | B2 | 3/2002 | Uchino et al. | |
| 6,466,191 | B1 * | 10/2002 | Choi et al. | 345/94 |
| 6,924,784 | B1 | 8/2005 | Yeo et al. | |
| 7,330,180 | B2 | 2/2008 | Inada | |
| 7,898,507 | B2 | 3/2011 | Takei et al. | |
| 2002/0171615 | A1 * | 11/2002 | Inoue et al. | 345/92 |
| 2004/0160404 | A1 * | 8/2004 | Nakajima et al. | 345/96 |
| 2005/0007324 | A1 * | 1/2005 | Inada | 345/87 |
| 2005/0116747 | A1 * | 6/2005 | Shimoda et al. | 327/108 |
| 2006/0050043 | A1 | 3/2006 | Kawagoe | |
| 2006/0290638 | A1 | 12/2006 | Ho et al. | |

FOREIGN PATENT DOCUMENTS

| | | | |
|---|---|---|---|
| JP | 2006-178494 | A | 7/2006 |
| TW | 200516847 | A | 5/2005 |
| TW | 200608333 | A | 3/2006 |
| TW | 200614126 | A | 5/2006 |

OTHER PUBLICATIONS

English translation of abstract and pertinent parts of TW 200516847 A, May 16, 2005.

(Continued)

*Primary Examiner* — Chanh Nguyen
*Assistant Examiner* — Tsegaye Seyoum
(74) *Attorney, Agent, or Firm* — McClure, Qualey & Rodack, LLP

(57) ABSTRACT

A liquid crystal display has a substrate, data lines, scan lines, pixel units and a pre-charge circuit. The data lines are disposed on the substrate in a first direction. The scan lines are disposed on the substrate in a second direction substantially perpendicular to the first direction. The pixel units are respectively disposed at the intersections of the data lines and the scan lines. The pre-charge circuit includes a pre-charge potential, a pre-charge capacitor and a pre-charge switch. The pre-charge capacitor has a first electrode coupled to the pre-charge potential. The pre-charge switch has a first terminal for receiving a pre-charge signal, a second terminal coupled to one of the data lines, and a third terminal coupled to a second electrode of the pre-charge capacitor.

15 Claims, 6 Drawing Sheets

(56) References Cited

OTHER PUBLICATIONS

English translation of abstract and pertinent parts of TW 200608333 A, Mar. 1, 2006.

Listing of pertinent parts of US 2002/0171615 A1, Nov. 21, 2002.

English translation of abstract of TW 200614126 A, May 1, 2006.

English translation of abstract of JP 2006-178494 A, Jul. 6, 2006.

* cited by examiner

LIQUID CRYSTAL DISPLAY WITH PRECHARGE CIRCUIT

RELATED APPLICATIONS

This application claims priority to Taiwan Patent Application Serial Number 96130935, filed Aug. 21, 2007, which is herein incorporated by reference.

BACKGROUND

1. Field of Invention

The present invention relates to a liquid crystal display, more particularly, relates to the pixel circuit in the liquid crystal display.

2. Description of Related Art

A liquid crystal display (LCD) comprises the scan switches, liquid crystal capacitors, and storage capacitors, wherein the storage capacitors can store the analog gray scale potential. Generally, common electrode voltage (VCOM) may use the direct current (DC) potential or the alternating current (AC) potential to drive the liquid crystal display. Both the DC potential and the AC potential may reverse the liquid crystal potential, thus prolonging the service life of the liquid crystal.

When the liquid crystal potential is reverted, pixel units and data lines may undergo twofold gray scale potential charging. However, in order to lower the overall cost, the conventional driving circuits wouldn't be provided with oversized driving buffers. Therefore, when the liquid crystal potential reversion is performed under greater gray scale potential, the liquid crystal display usually employs a pre-charge design to reduce the amount of buffers, so as to meet the consideration of the cost.

Common potential pre-charge design couples the data lines to the fixed potential, and uses this fixed potential to charge the data lines, so as to accomplish the purpose of pre-charging the potential. However, such design may pre-charge the potential of the data lines, from the perspective of overall power consumption, just replaces the power consumption of the buffer with the power consumption of the potential source. Although it may reduce the cost and difficulty in the buffer designing, it nevertheless doesn't reduce the power consumption of the liquid crystal display.

Hence, there is requirement in the related art to provide a pre-charge design to substantially reduce the overall power consumption of the liquid crystal display.

SUMMARY

According to one embodiment of the present invention, a liquid crystal display includes a substrate, data lines, scan lines, pixel units, and a pre-charge circuit. The data lines are disposed on the substrate in a first direction. The scan lines are disposed on the substrate in a second direction substantially perpendicular to the first direction. The pixel units are respectively disposed at the intersections of the data lines and the of scan lines. The pre-charge circuit has a pre-charge potential, a pre-charge capacitor and a pre-charge switch. The pre-charge capacitor has a first electrode coupled to the pre-charge potential. The pre-charge switch has a first terminal for receiving a pre-charge signal, a second terminal coupled to one of the data lines, and a third terminal coupled to a second electrode of the pre-charge capacitor.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
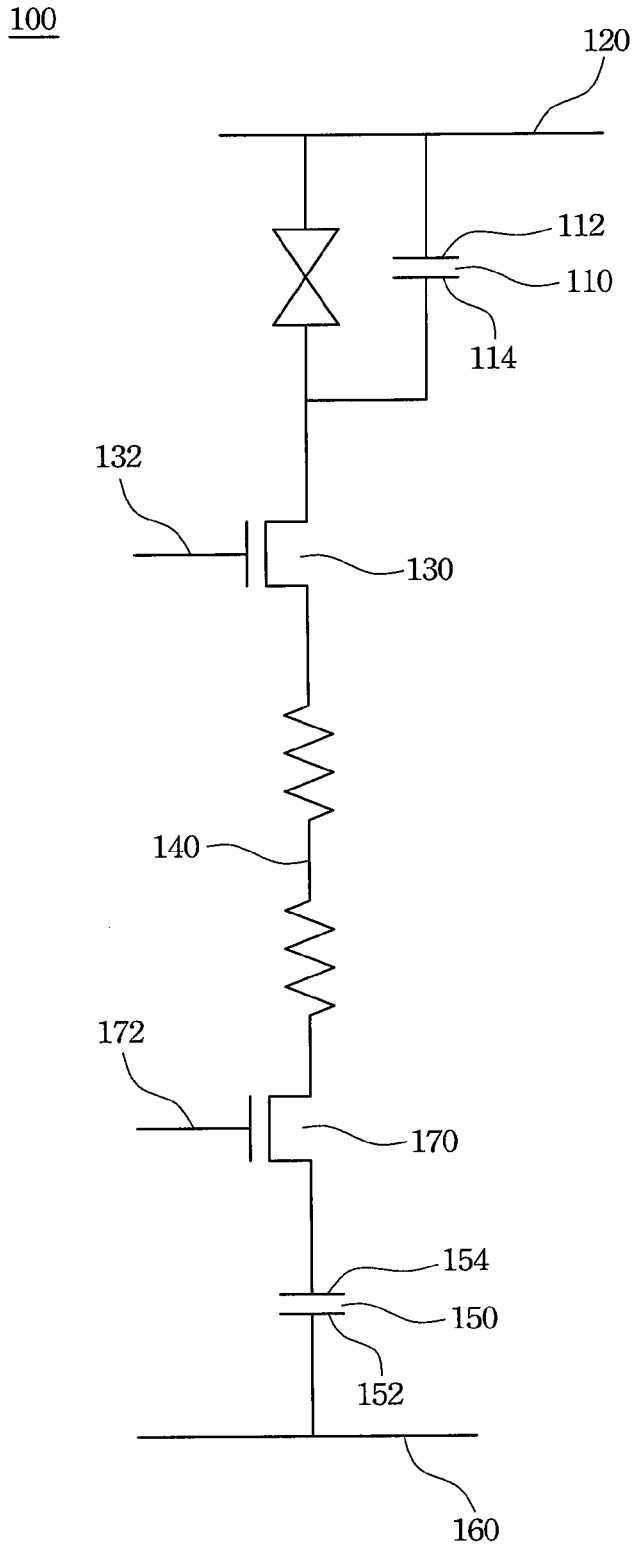
FIG. 1 is a schematic diagram illustrating the equivalent circuit of the pixel circuit according to one embodiment of the present invention.

Reference will now be made in detail to the present embodiments of the invention, examples of which are illustrated in the accompanying drawings. Wherever possible, the same reference numbers are used in the drawings and the description to refer to the same or like parts.

FIG. 1 is a schematic diagram illustrating the equivalent circuit of the pixel circuit 100 according to one embodiment of the present invention. The pixel circuit 100 includes a storage capacitor 110, a scan switch 130, a pre-charge capacitor 150, and a pre-charge switch 170. The storage capacitor 110 of the pixel circuit 100 has a first electrode 112 and a second electrode 114, wherein the first electrode 112 is coupled to a common potential 120. The scan switch 130 of the pixel circuit 100 is switched by the scan signal 132, so that the electrical connection between the data line 140 and the second electrode 114 can be turned on. The pre-charge capacitor 150 has a first electrode 152 and a second electrode 154, wherein the first electrode 152 is coupled to a pre-charge potential 160. The pre-charge switch 170 has a first terminal for receiving a pre-charge signal 172, a second terminal coupled to one of the data lines 140, and a third terminal coupled to the second electrode 154 of the pre-charge capacitor 150. The pre-charge switch 170 is switched by the pre-charge signal 172, so that the electrical connection between the data line 140 and the second electrode 154 can be turned on.

Since the first electrode 152 of the pre-charge capacitor 150 is coupled to the pre-charge potential 160, and the second electrode 154 is coupled to the data line 140, when the pre-charge potential 160 alters, the potentials of the first electrode 152 and second electrode 154 of the pre-charge capacitor 150 would alter correspondingly. After the pre-charge switch 170 turns on the electrical connection between the data line 140 and the second electrode 154, the data line 140 can be pre-charged by redistributing the charges. After completing the pre-charge of the data line 140, the write-in operation of the pixel gray scale potential data is performed, thus allowing the liquid crystal display to operate normally.

Therefore, the pre-charge signal 172 turns on the pre-charge switch 170 before the scan signal 132 turns on the scan switch 130, thereby allowing the data line 140 to be pre-charged before the pixel gray scale potential data is written into the pixel unit, hence reducing the requirement of buffer thrusting.

Furthermore, this embodiment uses the pre-charge capacitor 150 to pre-charge the data line 140 mainly by exchanging the charges between both the pre-charge capacitor 150 and the storage capacitor 110 and the polarities coupled to the data line 140. Thus, the charge variation within the entire line is small and thereby consumes almost no external electricity. Therefore, the power consumption of the entire pixel circuit 100 can be reduced.

The common potential 120 is driven by the DC mode and the AC potential. Hence, the operation potential of the common potential 120 and the pre-charge potential 160 can have a number of variations. Following paragraphs illustrate some embodiments exemplifying the possible forms. However, the embodiments only exemplify the possible variations, and the invention is not so limited.

First Embodiment

Figure 2:
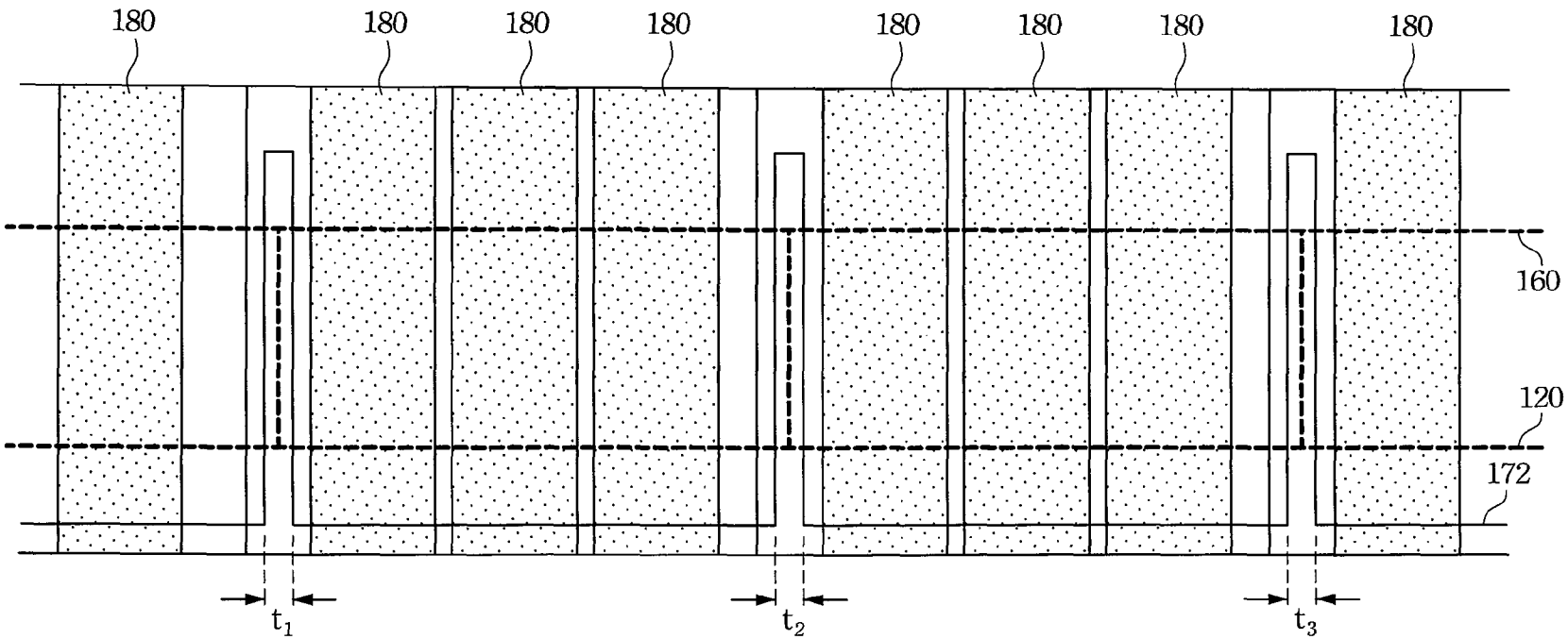
FIG. 2 is a timing diagram illustrating a first embodiment of the present invention.

In this embodiment, the common potential 120 and the pre-charge potential 160 both operate in the AC potential. Refer to both FIG. 1 and FIG. 2. FIG. 2 is a timing diagram illustrating the first embodiment of the present invention. As used in the figures, t1, t2 and t3 represent the time periods when the pre-charge switch 170 is turned on. When the pre-charge potential 160 alters, so does the potential of the first electrode 152 of the pre-charge capacitor 150. The potential of the second electrode 154 of the pre-charge capacitor 150 would also alter owing to the coupling. After the pre-charge switch 170 is turned on, the electrical connection between the data line 140 and the second electrode 154 of the pre-charge capacitor 150 would be turned on as well. Therefore, the potential of the data line 140 is the same as the potential of the second electrode 154 of the pre-charge capacitor 150 so that the data line 140 can be pre-charged. Afterward, the scan signal 132 subsequently turns on the scan switch 130, and the pixel gray scale potential data 180 would be written through the data line 140. Therefore, the pre-charge switch 170 should be turned on before the pixel gray scale potential data 180 is written through the data line 140.

When the outputs of the common potential 120 and the pre-charge potential 160 are both in the AC potentials, the output of the pre-charge potential 160 is the reverse signal of the output of the common potential 120, i.e., the phase of the pre-charge potential 160 is opposite to the phase of the common potential 120. In addition, in this embodiment, the potential reversion of the common potential 120 occurs during the time periods when pre-charge switch 170 is turned on, i.e., $t_1$, $t_2$ and $t_3$, so as to prevent the swing of the potential level of the data line 140 from getting too high.

Second Embodiment

Figure 3:
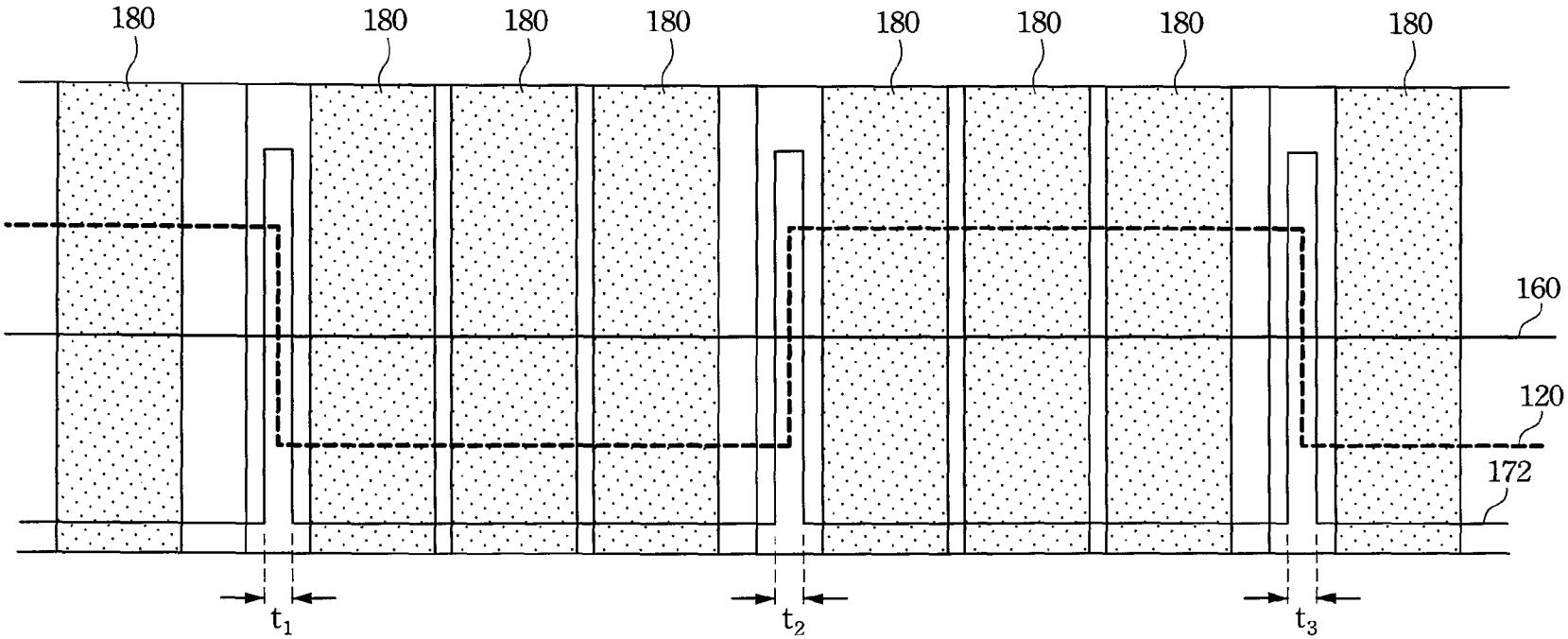
FIG. 3 is a timing diagram illustrating a second embodiment of the present invention.

In a second embodiment, the output of the common potential 120 is the AC potential, and the output of the pre-charge potential 160 is the DC potential. FIG. 3 is a timing diagram illustrating the second embodiment of the present invention. As shown in FIG. 3, the pre-charge switch 170 is still turned on before the pixel gray scale potential data 180 is written through the data line 140. In addition, in order to prevent the swing of the potential level of the data line 140 from getting too high, the reversion potential of the common potential 120 also occurs during the periods when the pre-charge switch 170 is turned on, i.e., $t_1$, $t_2$ and $t_3$.

The common potential 120 has a maximum potential and a minimum potential, and the pre-charge potential 160 is substantially equal to the mean of the maximum potential and the minimum potential. Hence, before the pixel gray scale potential data is written, the potential of the data line 140 is kept at the mean of the maximum and minimum potentials, so as to reduce the need of buffer thrusting.

Third Embodiment

Figure 4:
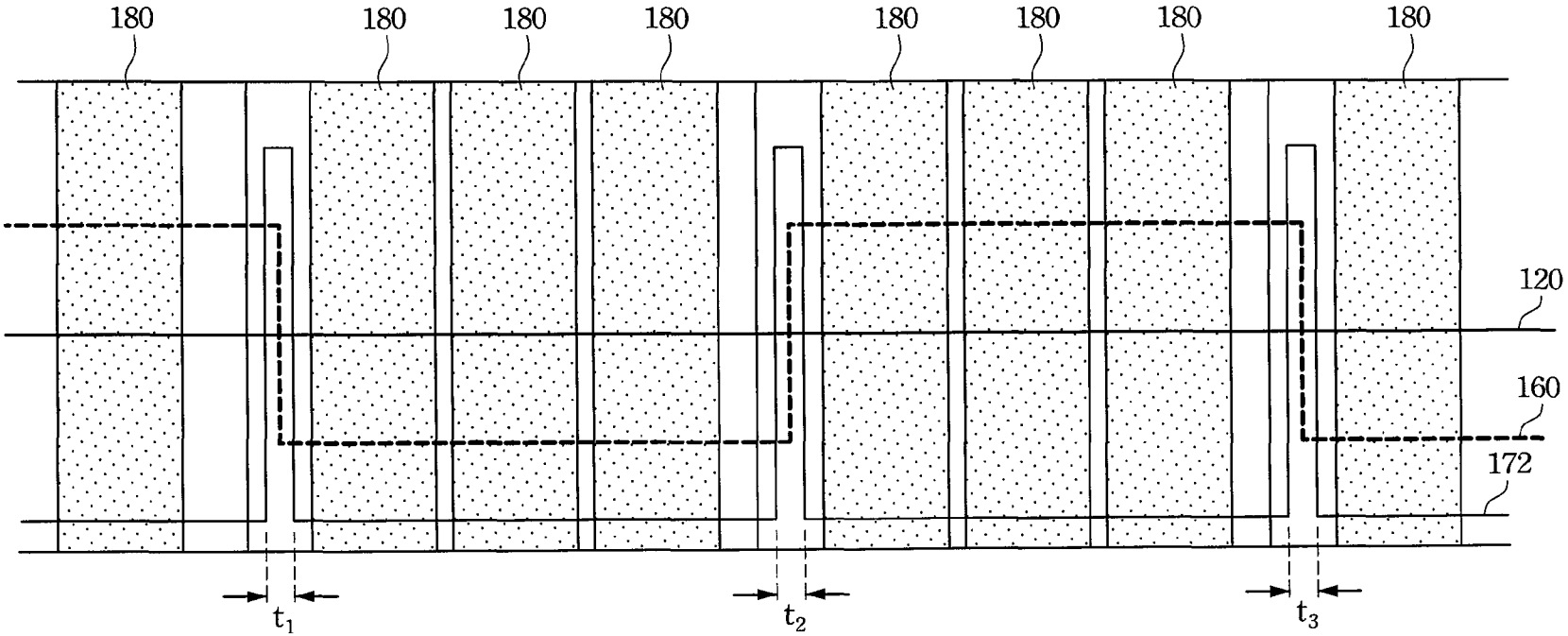
FIG. 4 is a timing diagram illustrating a third embodiment of the present invention.

FIG. 4 is a timing diagram illustrating a third embodiment of the present invention. In this embodiment, the output of the common potential 120 is the DC potential and the output of the pre-charge potential 160 is the AC potential. Similar to the second embodiment, the pre-charge switch 170 is turned on before the pixel gray scale potential data 180 is written through the data line 140. In order to prevent the swing of the potential level of the data line 140 from getting too high, the potential reversion of the pre-charge potential 160 occurs during the periods when the pre-charge switch 170 is turned on, i.e., t1, t2 and t3. Moreover, the pre-charge potential 160 has a maximum potential and a minimum potential, and the common potential 120 is substantially equal to the mean of the maximum potential and the minimum potential. Hence, the potential of the common potential 120 is kept at the mean of the maximum and minimum potentials of the data lines 140, so as to reduce the need of buffer thrusting.

Figure 5:
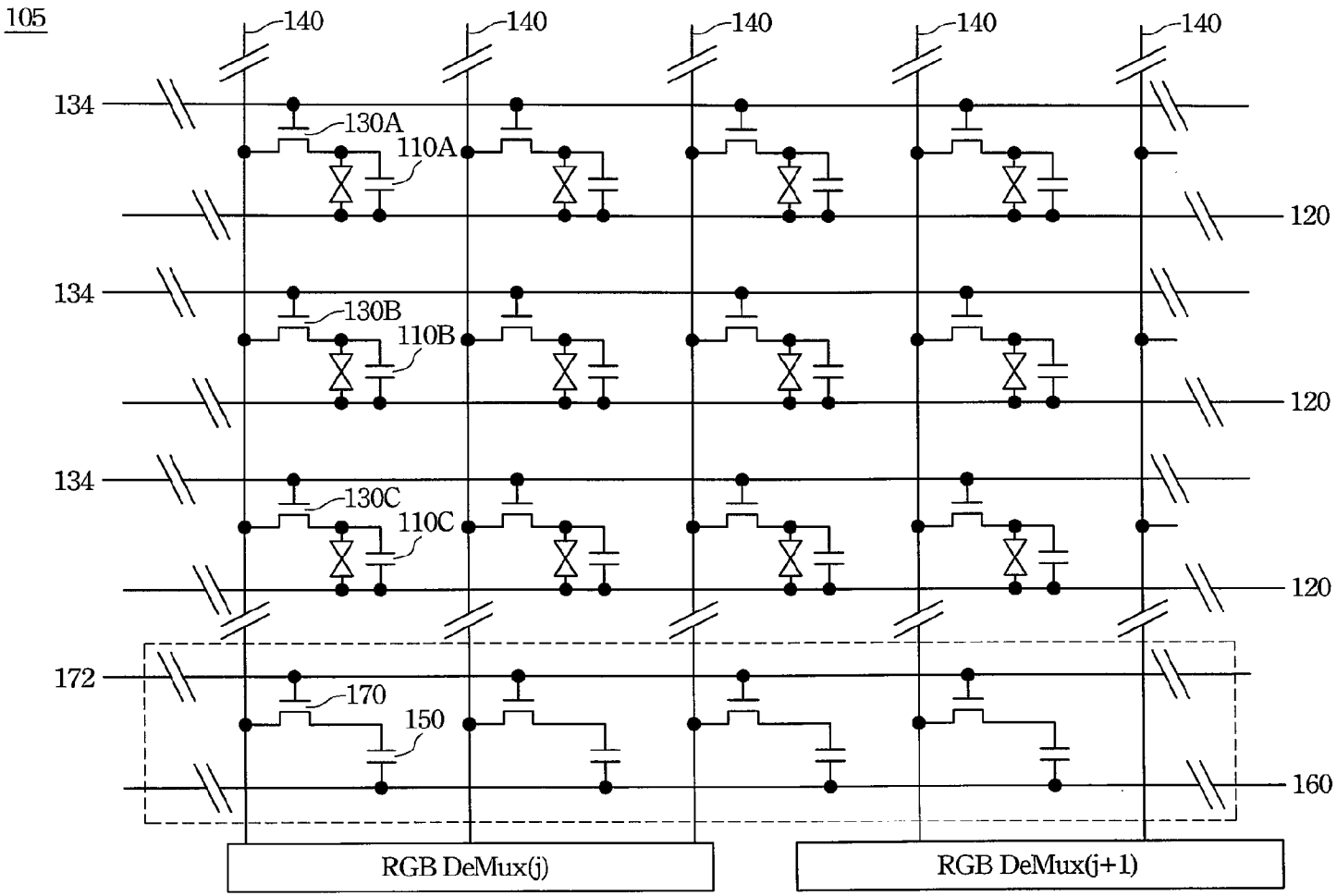
FIG. 5 is a schematic diagram illustrating a liquid crystal display, which has the pixel circuit of FIG. 1.

The above-described embodiments illustrate the common potential 120 and the pre-charge potential 160 operated in the DC and the AC potentials. FIG. 5 is a schematic diagram illustrating a liquid crystal display, which has the pixel circuit of FIG. 1. The storage capacitors 110A-110C of the pixel units are respectively disposed at the intersections of the data lines 140 and scan lines 134. Since the storage capacitors 110A-110C have their own scan switches 130A-130C for controlling whether to write the gray scale potential data in the pixel unit, the storage capacitors 110A-110C and the scan switches 130A-130C on a single data line 140 may share the pre-charge capacitor 150 and the pre-charge switch 170. The data lines 140, scan lines 134, and pixel units are all disposed on the substrate 105 of liquid crystal display. The capacitance of the pre-charge capacitor 150 is substantially equal to the capacitance of the storage capacitors 110A-110C of the pixel units.

Figure 6:
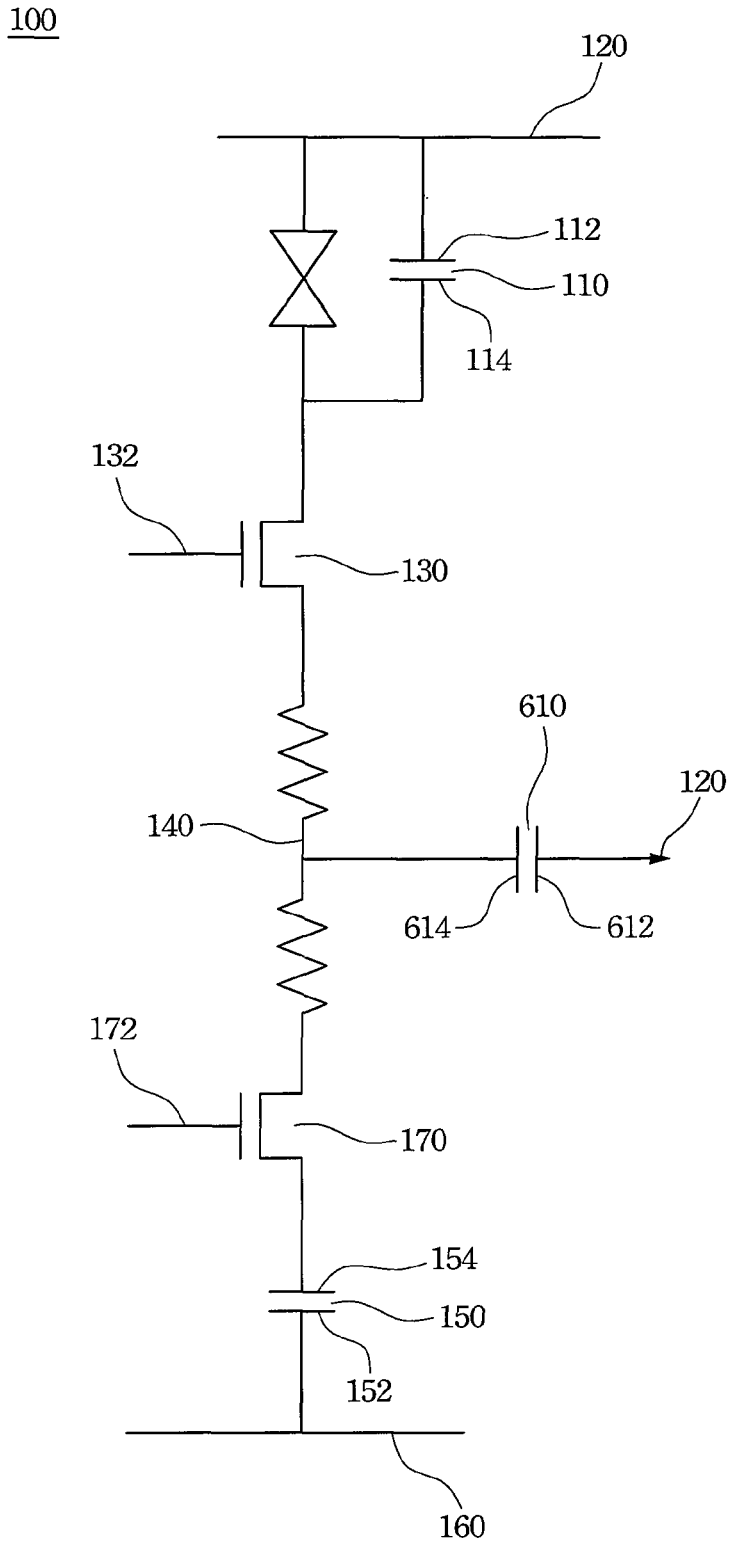
FIG. 6 is a schematic diagram illustrating the pixel circuit according to another embodiment of the invention.

FIG. 6 is a schematic diagram illustrating the pixel circuit according to another embodiment of the invention. In this embodiment, the effect of the parasitic capacitance 610 of the pixel circuit 100 is also taken into account. The parasitic capacitance 610 is resulted from the common potential 120 acting upon the data line 140. The parasitic capacitance 610 has a first electrode 612 and a second electrode 614, wherein the first electrode 612 is coupled to the common potential 120, and the second electrode 614 is coupled to the data line 140.

In a conventional pre-charge circuit designing, the parasitic capacitance 610 would consume great energy during the entire pre-charge process. In this embodiment, the pre-charge capacitor 150 is capacitive coupled to the parasitic capacitance 610 so as to reduce the required charges, thereby reducing the energy consumed during the pre-charge process. Also, according to this embodiment, the potential of the data line 140 is limited within the appropriate operation range through the use of voltage dividing operation. During the voltage dividing operation, the voltage level of the second electrode 614 of the parasitic capacitance 610 and the voltage level of the second electrode 154 of the pre-charge capacitor 150 are divided.

The example pixel circuits of the present invention use a set of pre-charge switch and pre-charge capacitor to pre-charge the data lines, therefore the entire circuit designing is quite simple. The pre-charge capacitor has one electrode coupled to the pre-charge potential and other electrode thereof coupled to the data line. Therefore, when the pre-charge potential alters, the potential of the data line alters correspondingly, so that the data line is pre-charged. Moreover, the charges are mainly exchanged between the electrode of the pre-charge capacitor coupled with the data line and the electrode of the storage capacitor coupled with the data line. Therefore, the charge variation within the entire line is small, thus reducing the overall power consumption of the pixel circuit. When the outputs of both the pre-charge potential and the common potential are in the AC potential, only the phases of the pre-charge potential and the common potential should be reversed. The accuracy of the level of the DC needs not to be high, and thus consumes no additional electricity and is easy to design.

In addition to the above mentioned features, by the use of the pre-charge potential, the initial potential of the data lines can be limited between the voltage levels for delivering data, thus reducing the level gradient of the subsequent charging of the pixel unit. Since the level gradient of the subsequent charging of the pixel unit is reduced, the time needed for charging the pixel unit is also reduced, which means the steady state of the level of the gray scale can be shorten. In addition, the coupling effect resulted from the pixel units gray scale potential acting upon the common potential can be lowered, thereby effectively inhibiting the cross talk effect.

Although the present invention has been described in considerable detail with reference t certain embodiments thereof, other embodiments are possible. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims. Therefore, their spirit and scope of the appended claims should no be limited to the description of the embodiments contained herein.

What is claimed is:

1. A liquid crystal display, comprising:

a substrate;

a plurality of data lines disposed on the substrate in a first direction for providing data signals;

a plurality of scan lines disposed on the substrate in a second direction substantially perpendicular to the first direction for providing scan signals;

a plurality of pixel units respectively disposed at the intersections of the data lines and the scan lines; and a pre-charge circuit comprising:

a pre-charge potential;

a pre-charge capacitor having a first electrode coupled to the pre-charge potential, and a second electrode; and a pre-charge switch having a first terminal for receiving a pre-charge signal, a second terminal coupled to one of the data lines, and a third terminal coupled to the second electrode of the pre-charge capacitor, wherein the pre-charge switch is turned on by the pre-charge signal before the scan signals turn on the pixel units, wherein the capacitance of the pre-charge capacitor is substantially equal to the capacitance of a storage capacitor of the pixel units, wherein the voltage of the data line is independent of the pre-charge potential, and the pre-charge potential is directly coupled with the pre-charge capacitor, wherein a common potential and the pre-charge potential change their respective polarities within a time period during which the pre-charge switch is turned on.

2. The liquid crystal display of claim 1, further comprising a common potential coupled to the pixel units, wherein the common potential is an alternating current (AC) potential.

3. The liquid crystal display of claim 2, wherein the phase of the pre-charge potential is opposite to the phase of the common potential.

4. The liquid crystal display of claim 2, wherein the common potential is reversed when the pre-charge switch is turned on.

5. The liquid crystal display of claim 2, wherein the pre-charge potential is a direct current (DC) potential.

6. The liquid crystal display of claim 5, wherein the common potential has a maximum potential and a minimum potential, and the pre-charge potential is substantially equal to the mean of the maximum potential and the minimum potential.

7. The liquid crystal display of claim 1, further comprising a common potential coupled to the pixel units, wherein the common potential is a DC potential.

8. The liquid crystal display of claim 7, wherein the pre-charge potential is an AC potential.

9. The liquid crystal display of claim 8, wherein the pre-charge potential has a maximum potential and a minimum potential, and the common potential is substantially equal to the mean of the maximum potential and the minimum potential.

10. The liquid crystal display of claim 9, wherein the pre-charge potential is reversed when the pre-charge switch is turned on.

11. The liquid crystal display of claim 1, wherein the data lines each has a plurality of storage capacitors and a plurality of scan switches sharing the pre-charge capacitor and the pre-charge switch.

12. The liquid crystal display of claim 1, further comprising:

a common potential coupled to the pixel units; and a parasitic capacitance having two electrodes respectively coupled to the common potential and the data lines.

13. The liquid crystal display of claim 1, wherein the polarity of the common potential is opposite to the polarity of the pre-charge potential.

14. A liquid crystal display, comprising:

a substrate;

a plurality of data lines disposed on the substrate in a first direction for providing data signals;

a plurality of scan lines disposed on the substrate in a second direction substantially perpendicular to the first direction for providing scan signals;

a plurality of pixel units respectively disposed at the intersections of the data lines and the scan lines; and a pre-charge circuit comprising:

a pre-charge potential;

a pre-charge capacitor having a first electrode coupled to the pre-charge potential, and a second electrode; and a pre-charge switch having a first terminal for receiving a pre-charge signal, a second terminal coupled to one of the data lines, and a third terminal coupled to the second electrode of the pre-charge capacitor, wherein a common potential and the pre-charge potential change their respective polarities within a time period during which the pre-charge switch is turned on.

15. The liquid crystal display of claim 14, wherein the polarity of the common potential is opposite to the polarity of the pre-charge potential.

* * * * *